US005651224A

United States Patent [19]

Brabant

[11] Patent Number: 5,651,224

[45] Date of Patent: Jul. 29, 1997

[54] ARCHITECTURAL MOLDING ASSEMBLY WITH CLAMPING BRACKETS

[75] Inventor: Robert Brabant, Laprairie, Canada

[73] Assignee: Clips 2000 Inc., Iberville, Canada

[21] Appl. No.: 416,282

[22] Filed: Apr. 4, 1995

[51] Int. Cl.[6] ..... E04F 19/04

[52] U.S. Cl. ..... 52/288.1; 52/716.8; 52/718.04; 52/718.06; 52/718.03

[58] Field of Search ..... 52/288.1, 716.8, 52/717.06, 718.01, 718.04, 287.1, 280, 718.06, 718.03; 403/295, 298

[56] References Cited

U.S. PATENT DOCUMENTS

| | | | |
|---|---|---|---|
| 417,949 | 12/1889 | Sagendorph | 52/288.1 |
| 1,229,765 | 6/1917 | Lehman | 52/288.1 |
| 2,069,289 | 2/1937 | Swendsen et al. | 52/288.1 |
| 3,201,910 | 8/1965 | Keesee | 52/287.1 |
| 3,410,045 | 11/1968 | Meyer | 52/718.04 |
| 3,464,177 | 9/1969 | Amato | 52/718.04 X |
| 3,481,092 | 12/1969 | Constantino | 52/287.1 |
| 3,707,061 | 12/1972 | Collette et al. . | |
| 3,742,668 | 7/1973 | Oliver | 52/288.1 |
| 3,977,112 | 8/1976 | Breer II | 52/287.1 X |
| 5,001,877 | 3/1991 | Edwards | 52/288.1 |
| 5,042,220 | 8/1991 | Jackson . | |
| 5,179,811 | 1/1993 | Walker et al. | 52/288.1 |
| 5,186,509 | 2/1993 | Tyves | 52/718.04 X |
| 5,353,571 | 10/1994 | Berdan et al. | 52/718.04 X |
| 5,359,817 | 11/1994 | Futton | 52/288.1 |
| 5,433,048 | 7/1995 | Strasser | 52/288.1 |

FOREIGN PATENT DOCUMENTS

| | | | |
|---|---|---|---|
| 624458 | 9/1961 | Italy | 52/288.1 |

*Primary Examiner*—Carl D. Friedman
*Assistant Examiner*—Aimee E. McTigue

[57] ABSTRACT

An architectural molding assembly is comprised of straight molding pieces having a decorative outer surface and a channel in the rear surface thereof. A wall attaching plate is slidingly secured in the channel and has a slot or an aperture therein to engage with a fastener which is secured to a wall. The fastener may be in the form of a screw or a clamp having a projecting finger. When the attaching plates are engaged by the fasteners they are urged against the wall and maintained there under tension. No nail is inserted in the molding and molding connecting pieces and accordingly the assembly can be easily dismantled and remounted when desired.

14 Claims, 6 Drawing Sheets

ARCHITECTURAL MOLDING ASSEMBLY WITH CLAMPING BRACKETS

TECHNICAL FIELD

The present invention relates to an architectural molding assembly wherein straight molding pieces are provided with a channel in a rear wall thereof to receive one or more slidable attaching plates. The plates are engageable to a wall surface by fasteners and when connected thereto the molding pieces are retained under pressure against a wall surface.

BACKGROUND ART

Decorative molding assemblies which are secured on a wall by fastener elements are known, such as described in U.S. Pat. No. 5,042,220 issued on Aug. 27, 1991 and U.S. Pat. No. 3,707,061 issued on Dec. 26, 1972. These two patents disclose the provision of fasteners to hold decorative type molding against various areas of a wall surface including areas adjacent floor or ceiling surfaces. They are also connectible and disconnectible to these areas by means of clamps. In U.S. Pat. No. 3,707,061, the moldings are of the flexible type and are extruded of plastics material specifically designed to engage with custom designed fastener elements. In U.S. Pat. No. 5,042,220, the architectural moldings are fabricated from wood, and are engaged by fastener strips. To disengage the moldings they must be twisted and this could damage the prongs of the fastener.

SUMMARY OF INVENTION

The present invention relates to an architectural molding assembly of the above type utilizing a different assembly concept which provides flexibility and economy and makes it easy to install moldings and to remove them when necessary, such as when painting a room, wallpapering, running cables behind moldings, etc. and without damage to the moldings or fasteners. Additionally, the molding assembly of the present invention retains wooden moldings in tension against a wall surface thereby causing the molding to follow imperfections in the flatness of walls.

BRIEF DESCRIPTION OF DRAWINGS

According to the above feature of the present invention and in accordance with a broad aspect thereof, there is provided an architectural molding assembly which comprises one or more straight molding pieces having an outer face. A channel is disposed longitudinally in at least portions of an inner face of the one or more molding pieces. A longitudinal groove is formed in opposed edges of the channel. A wall attaching plate is removably securable and slidable between the grooves and has a transverse fastener slot therein. The slot has a fastener head receiving opening at a lower end thereof. The plate has sloped shoulder portions on opposed sides of at least a portion of the slot. The plate has connecting end flanges to slidingly secure same in the channel with the slot extending vertically with respect to the molding piece and the slope shoulder facing inwardly of the channel and spaced from the bottom wall of the channel. The molding piece is secured against the wall surface by one or more fasteners secured in the wall with a head of the fastener spaced outwardly a predetermined distance. The fastener heads are received in respective ones of the fastener head receiving openings of two or more of the wall attaching plates disposed in the channel. The molding piece is then secured to the wall by pressing same in the direction of the wall and then downward to cause the heads of the fasteners to enter the slots and frictionally engage with the shoulder portions to draw the molding against the wall and with the plate maintaining a pulling force on the molding against the wall surface.

According to a further broad aspect of the present invention, the wall attaching plate is provided with a clamp receiving aperture in a lower portion thereof. The molding piece is secured against the wall surface and a ceiling surface by one or more fasteners secured to the wall adjacent the ceiling surface with a projecting finger of the fastener extending outwardly upwards a predetermined distance. The projecting finger is received in the clamping aperture of one of the one or more attaching plates disposed in the channel. The molding piece is secured to the wall and against an adjacent ceiling surface by pushing the molding to make the projecting finger enter the aperture and pull the molding in a clamping position between the wall and ceiling surfaces as it is pushed against the finger which maintains a pulling force on the attaching plate and molding.

DESCRIPTION OF PREFERRED EMBODIMENT

Figure 1:
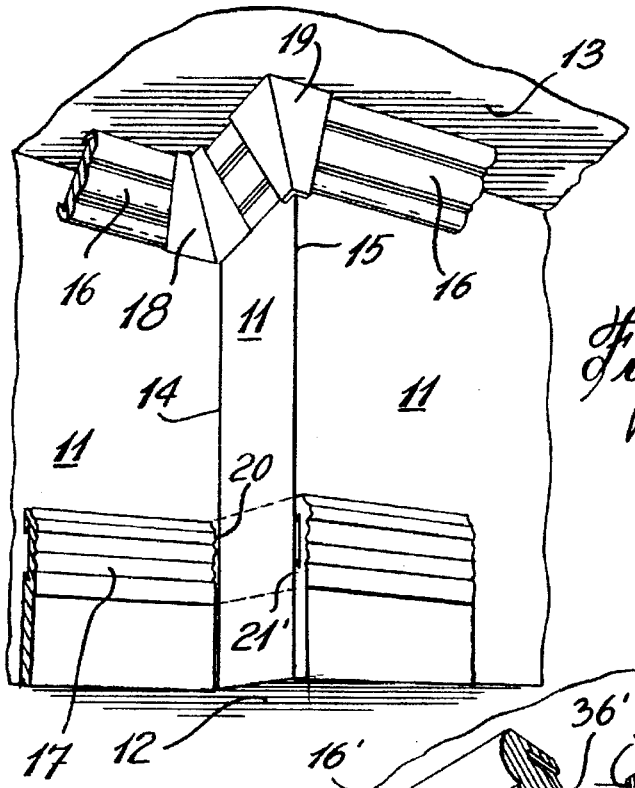
Figure 2:
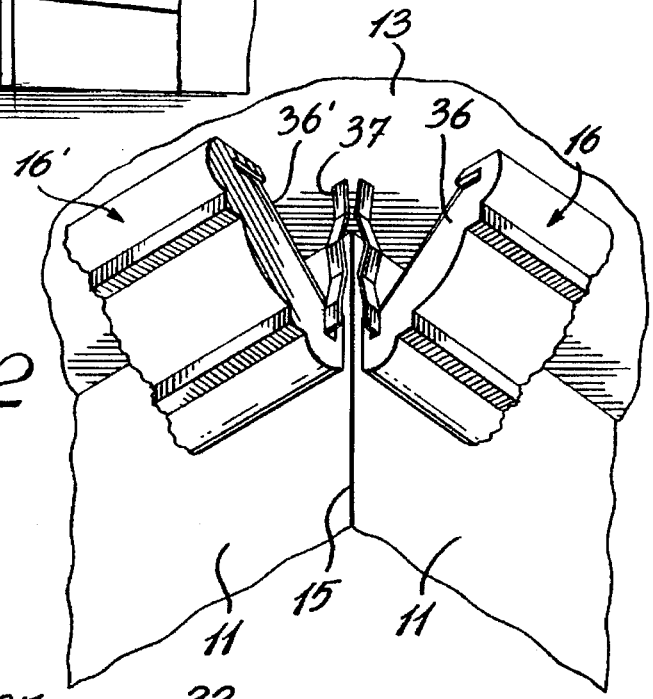
Figure 4:
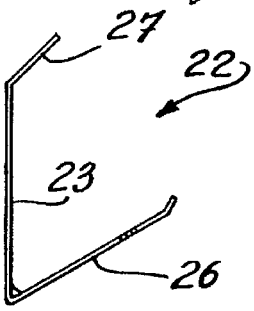
Figure 3:
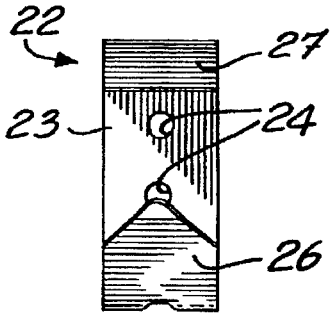
Figure 5:
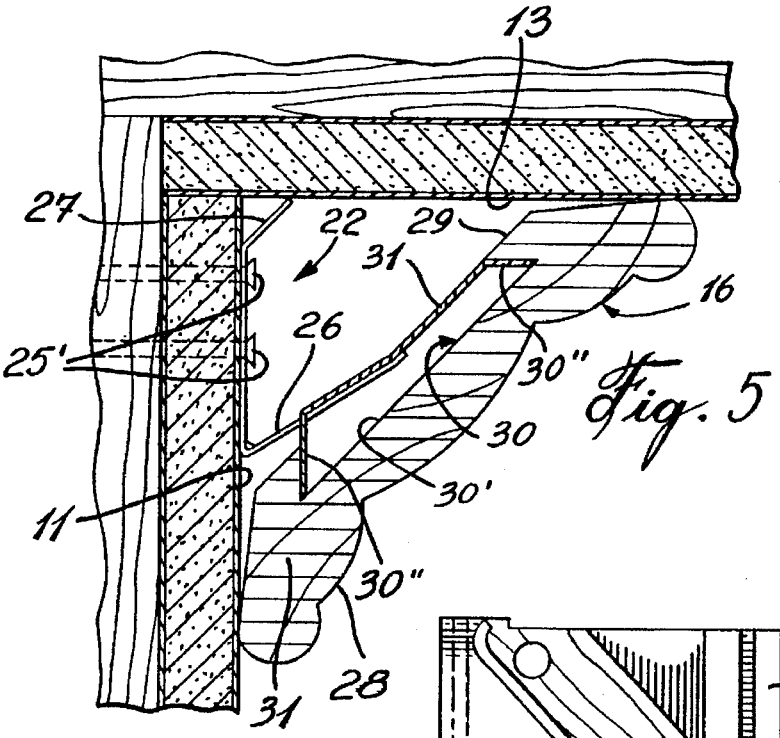
Figure 8:
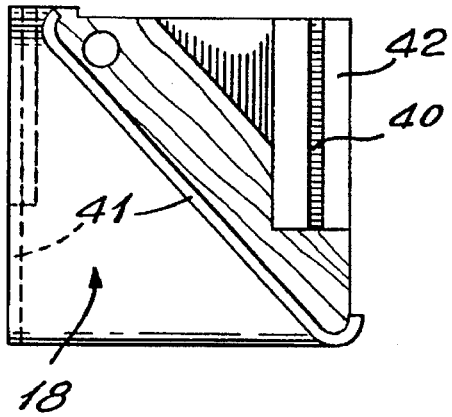
Figure 6:
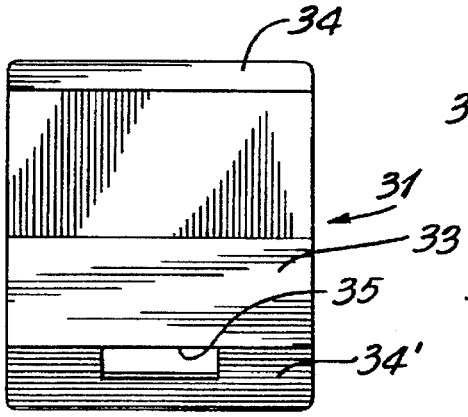
Figure 7:
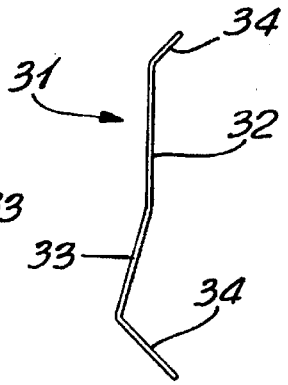
Figure 10:
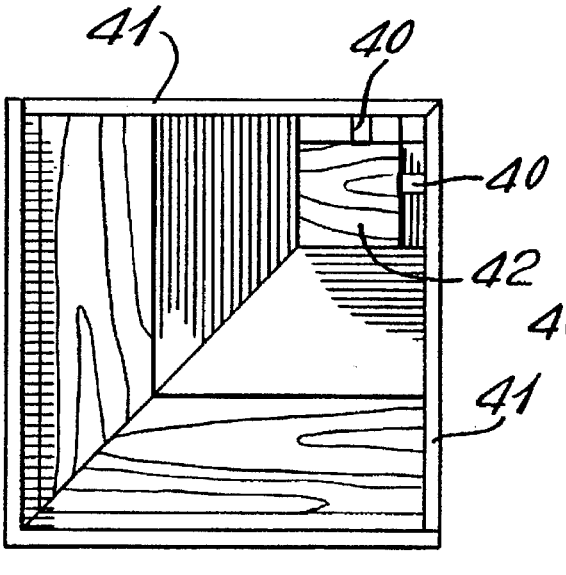
Figure 9:
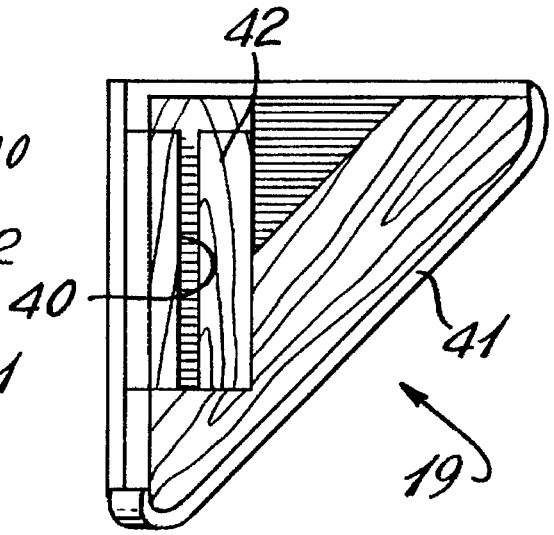
Figure 12:
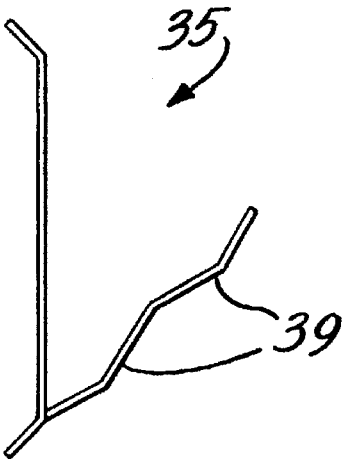
Figure 11:
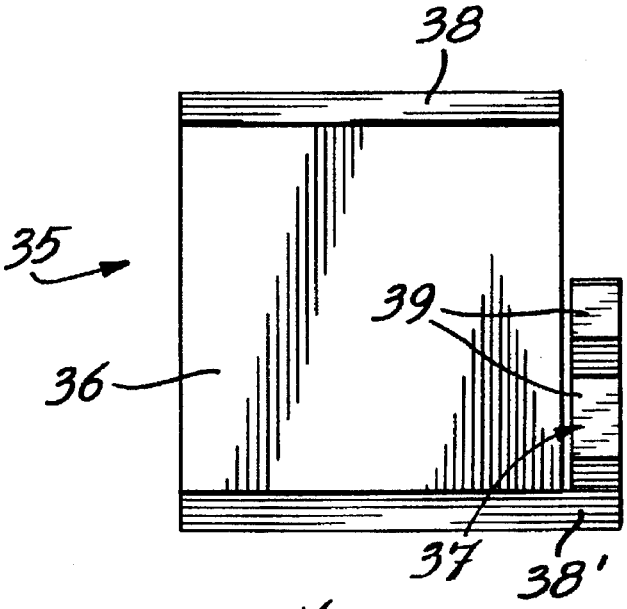
Figure 13:
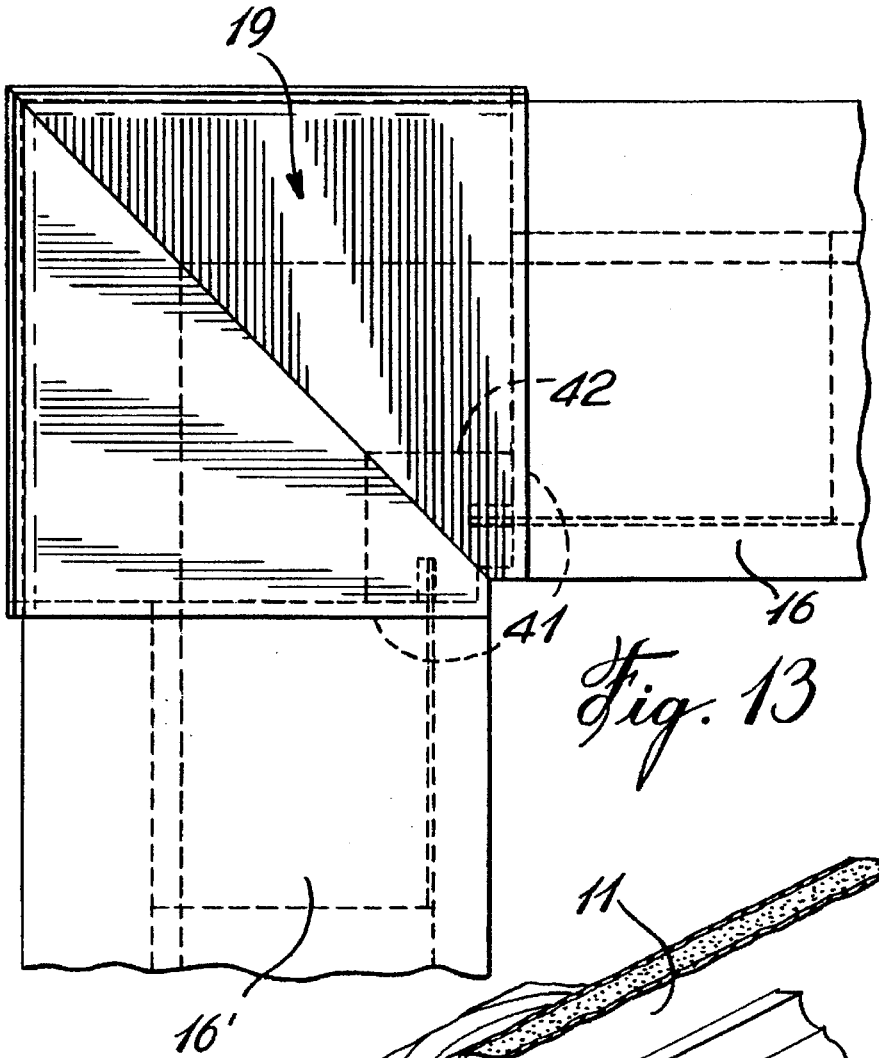
Figure 14:
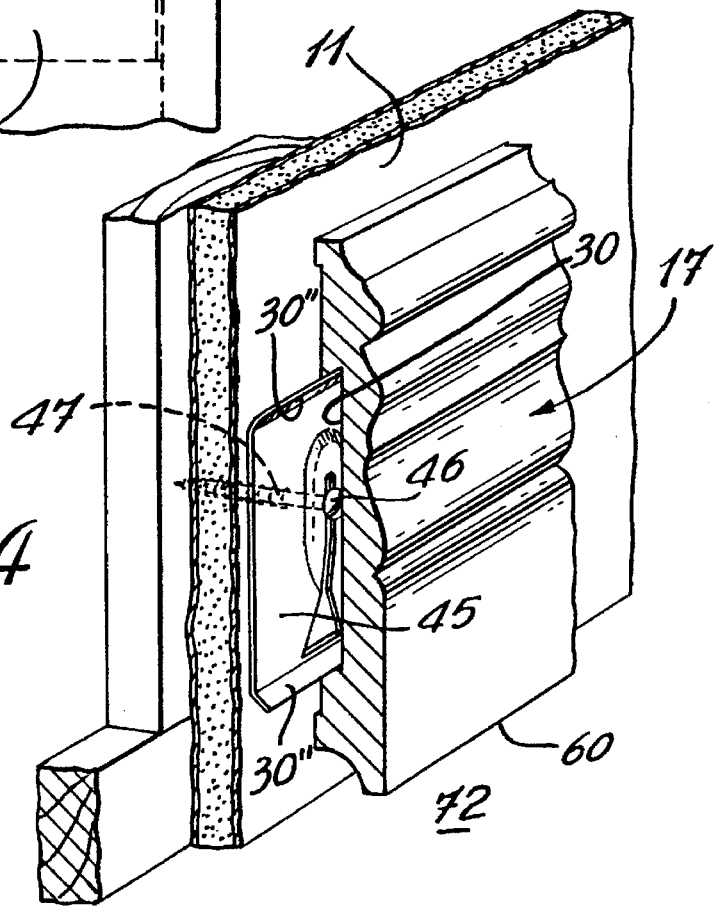
Figure 15:
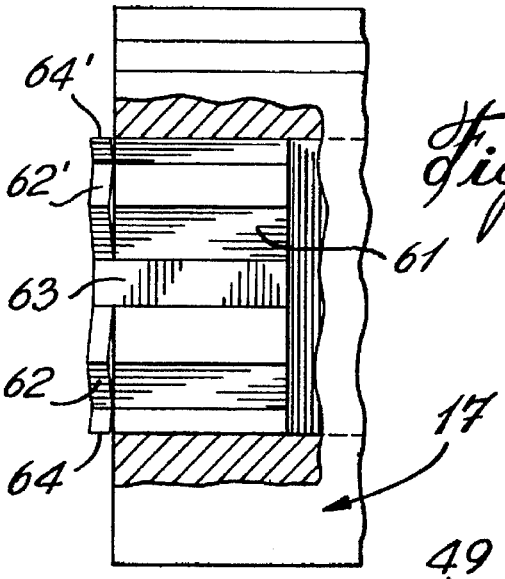
Figure 16:
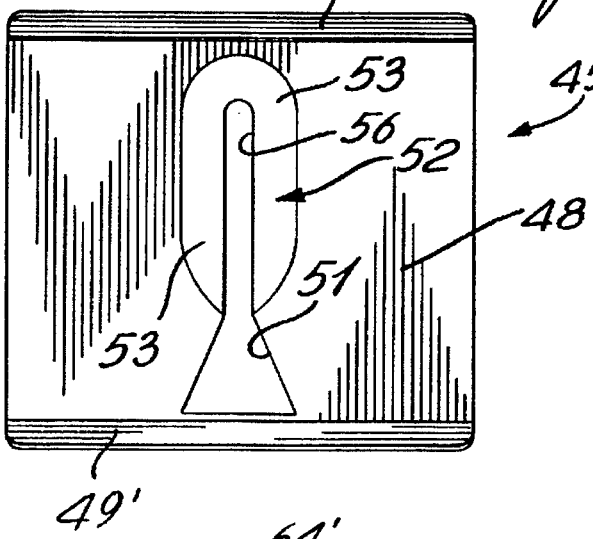
Figure 17:
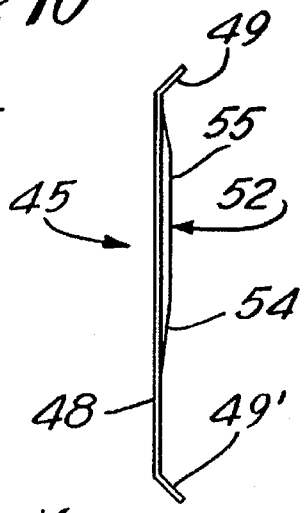
Figure 18:
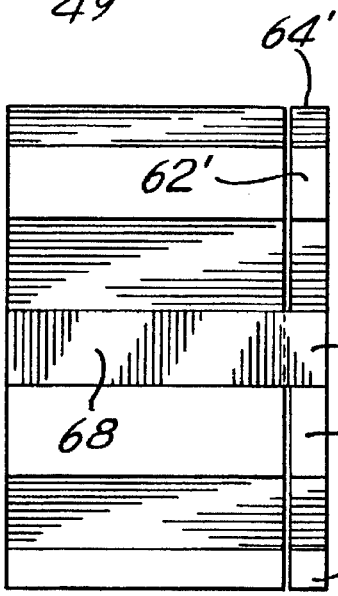
Figure 19:
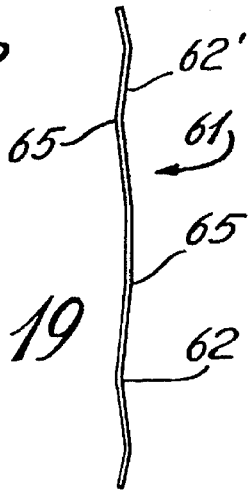
Figure 20:
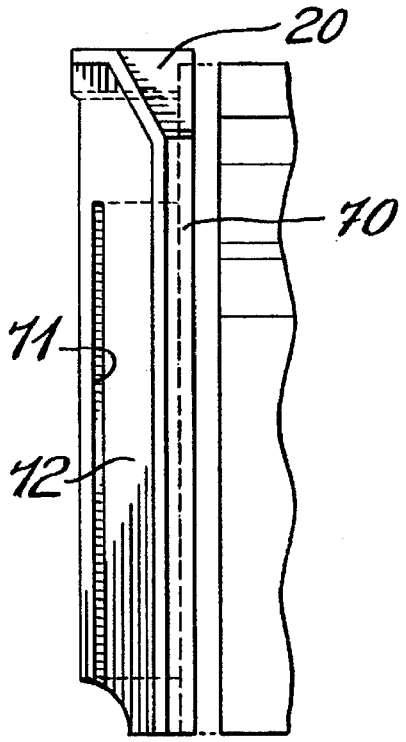
Figure 21:
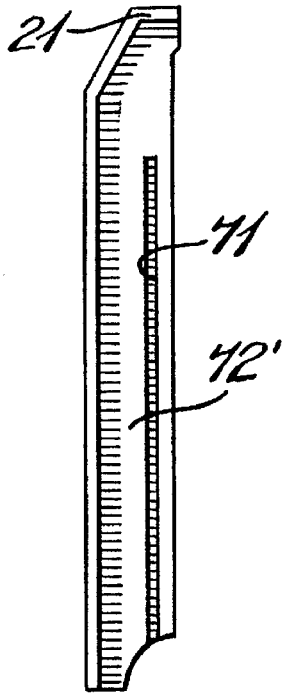

A preferred embodiment of the present invention will now be described with reference to the accompanying drawings in which:

FIG. 1 is a perspective view showing fragmented sections of walls on which there is removably secured molding pieces provided with the attaching assembly of the present invention;

FIG. 2 is a fragmented perspective view showing straight moldings installed between a wall and a ceiling surface but with a right-angle interconnecting molding piece having been removed to illustrate the construction and position of the connecting end flanges;

FIG. 3 is a front view of the fastener clamp to secure the moldings of FIG. 2 adjacent a wall and ceiling surface;

FIG. 4 is a side view of FIG. 3;

FIG. 5 is a section view showing the clamp of FIG. 3 engaged with the wall attaching plate slidingly secured to a straight molding piece;

FIG. 6 is a plan view of the wall attaching plate;

FIG. 7 is a side view of FIG. 6;

FIG. 8 is a side view of an inside corner molding piece for use with the molding pieces as shown in FIG. 2;

FIG. 9 is a side view of an outside corner molding piece for securement over the outside corner of the two moldings, as shown in FIG. 2;

FIG. 10 is a top view of the outside corner molding piece of FIG. 9;

FIG. 11 is a plan view of an end connector secured in the channel in the rear surface of the molding piece adjacent the ends thereof;

FIG. 12 is a side view of the end connector of FIG. 11;

FIG. 13 is a bottom view looking at the outside corner piece of FIGS. 9 and 10 secured on the outside corner of FIG. 2 and overlapping the free ends of the two right-angle molding pieces;

FIG. 14 is a perspective view showing a baseboard type decorative molding secured against the wall by means of a wall attaching plate which is removably secured in the slot provided in the back wall of the molding;

FIG. 15 is a fragmented view illustrating the position of an end connector secured in the groove of the baseboard of FIG. 14 adjacent an end thereof;

FIG. 16 is a plan view of a wall attaching plate;

FIG. 17 is a side view of FIG. 16;

FIG. 18 is an enlarged plan view of the end connector of FIG. 15;

FIG. 19 is a side view of FIG. 18;

FIG. 20 is a side view showing an inside corner connector molding piece secured to the end of a baseboard molding;

FIG. 21 is a side view of the outside corner connector molding piece; and

Figure 22:
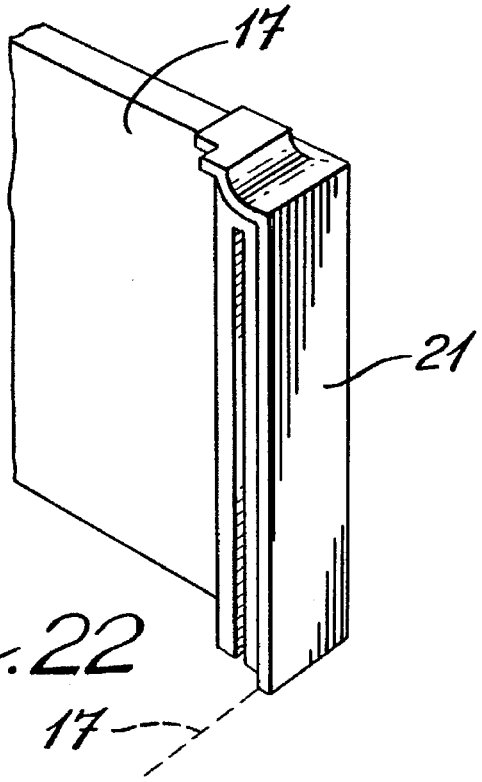

FIG. 22 is a perspective view showing an outside corner connecting molding piece for interconnecting baseboards around an outside corner where the baseboards extend at 90° to one another.

DESCRIPTION OF PREFERRED EMBODIMENTS

Referring now to the drawings and more particularly to FIG. 1, there is shown generally at 10 the architectural molding assembly of the present invention secured against wall surfaces 11 of a room and positioned adjacent a floor surface 12 and a ceiling surface 13. Dado-type decorative moldings may also be secured against the wall surface intermediate the ceiling and floor surfaces. As also herein shown, the architectural molding assembly of the present invention is secured around an inside corner 14 and an outside corner 15 of the wall surfaces 11. The molding pieces herein shown comprises straight molding pieces 16 connected at an angle between the wall surface 11 and the ceiling 13 and straight molding pieces 17 connected against the wall surface 11 adjacent the floor 12. Interconnecting moldings are also connected at the ends thereof with an inside corner connecting molding piece 18 and an outside molding corner connecting molding piece 19. Similarly, the straight moldings 17 have an inside corner connector molding 20 to interconnect two moldings at right angles thereto, and an outer corner molding piece 21 to connect the ends of two moldings disposed at 90° at the outside corner 15 of the wall surfaces 11.

With additional reference to FIGS. 2 to 7, the molding assembly for securing the molding pieces to the walls will be described. The straight molding piece 16 is secured diagonally between the ceiling surface 13 and the wall surface 11 by one or more fastening brackets 22, as shown in FIGS. 3 and 4. The fastening brackets 22 are secured to the wall 11 and are hidden behind the molding pieces 16 and 16'. The fastening bracket 22 as shown in FIGS. 3 and 4, consist of a clamp having a wall attaching body 23 provided with one or more holes 24 therein for receiving screws 25' (see FIG. 5) to secure same in the wall surface 11. A projecting finger 26 is formed integral therewith at a lower end of the body 23 and projects in a front end thereof. The other end of the clamp may have an inwardly facing flange 27.

As shown in FIG. 5, the straight molding piece 16 has a decorative surface 28 and a rear flat surface 29 in which an elongated channel 30 is routed, or otherwise formed. The channel 30 has opposed longitudinal grooves or undercuts 30" to receive in said channel, in sliding connection therewith, a wall attaching plate 31.

The wall attaching plate 31 is better illustrated in FIGS. 6 and 7 and is formed from a flat metal sheet. The attaching plate has connecting end flanges 34 which are angled to one side of the plate inwardly of the channel 30, as shown in FIG. 5. These end flanges also support the flat wall section 32 of the plate spaced from the bottom wall 30' of the channel 30, as shown in FIG 5. The flat wall section 32 also has an outwardly angulated wall section 33 which extends to the lower connecting end flange 34'. A clamping aperture 35 is provided in the lower connecting end flange 34' immediately below the outwardly angulated wall section 33 to receive the projecting finger 26 of the fastener clamp 22 in order to install the molding piece 16 against the wall surface 11 and ceiling surface 13. This is done by placing the aperture 35 at the end of the projecting finger 26 and pushing the molding inwardly towards the corner of the wall surfaces to cause the projecting finger to enter the aperture and pull the molding in clamping position between the wall surface 11 and the ceiling surface 13. This causes the projecting finger 26 to frictionally engage the back wall of the outwardly angulated wall section 33 and to flex the finger downwardly thereby applying a pulling force to said wall attaching plate 31 and consequently said straight molding piece 16 connected thereto so that it is retained flush against the wall surface 11 and ceiling surface 13, and causes it to follow substantially imperfections or deviations in the flatness of these surfaces. When a wall has a curved surface it is preferable to install more fasteners 22 in the depression or the bulge, and seeing that the plates 31 are slidable in the channel, they are easily aligned with a respective fastening bracket 22.

Referring now to FIGS. 11 and 12, there is shown the construction of an end connector 35 which is secured in the channel 30 at an end of the molding pieces 16 to connect a further decorative molding piece or interconnecting molding piece adjacent these ends. The end connector is a metal plate having a channel connecting portion 36 adapted for sliding retention in the channel 30. The end connector 35 also has a decorative molding piece connecting end 37 formed integral therewith and extending from a lower connecting end flange 38'. Channel connecting portion 36 also has a pair of lower connecting end flanges 38 and 38' both extending rearwardly thereof to engage in the undercut grooves 31 of the channel 30.

When the end connector is installed within the channel, this decorative molding piece connecting end 37 extends outwardly from an end of the channel of the molding piece. As herein shown, this connecting end 37 is in the form of a metal finger having undulations 39 therein, as better seen in FIG. 12, for frictional retention with a connecting slot 40 of an outside corner connecting piece 19, see FIGS. 9 and 10.

As shown in FIGS. 9 and 10, the outside corner connecting piece also has opposed lip flanges 41 to overlap the ends of two adjacent right-angle decorative molding pieces 16 and 16', as shown in FIG. 2, of a right-angle outside corner 15. Each of these moldings 16 and 16' has end connectors 36 and 36' respectively fitted therein with the fingers 37 and 37' thereof extending substantially vertically upwards. The connecting slot 40 is provided in an attaching block 42 and there are two slots 40 disposed at right angles to one another to receive respectively therein one of the fingers 37 of opposed end connectors 36 and 36'. These fingers also bias the outside corner molding piece 19 against the ends of the straight molding pieces 16 and 16'. This is better illustrated in FIG. 13. Accordingly, the outside corner molding piece is simply pushed up into engagement from the bottom of the open V-joint, as shown in FIG. 2, and is locked into place by the metal fingers 37. The end connectors as well as the fastening bracket and wall attaching plate are all formed from treated steel so as to provide a spring force against the molding pieces to hold them in clamping position. With this assembly it is not necessary to insert any nail or screw in the moldings as these moldings are readily removable by simply prying them out of position as desired, for instance, when repainting, wallpapering walls or running wires or pipes behind these moldings as is necessary.

Referring now to FIG. 14, there is shown a fragmented section of a baseboard-type decorative molding 17 which is secured against the wall surface 11 adjacent the floor surface 12. As herein shown, the molding is also provided with a channel 30 and in which there is secured a wall attaching plate 45 for clamping engagement with the head 46 of fastener 47 secured in the wall surface 11. As herein shown, the fastener 47 is a screw fastener.

Referring now to FIGS. 16 and 17, there is shown the construction of the wall attaching plate of the present invention which is removably securable between the undercut grooves 30" of the channel 30. The wall attachment plate 45 is a substantially rectangular plate stamped from a metal sheet and has a flat wall portion 48 having opposed connecting end flanges 49 and 49' facing a common side of the flat wall portion 48, as shown in FIG. 17. A transverse fastener receiving slot 50 is provided in the flat wall portion 48. The slot has an enlarged fastener head receiving opening 51 in a bottom end thereof adjacent the end flange 49' for receiving the head 46 of the fastener 47 therein. An embossment 52 is stamped about the slot 50 to form sloped shoulder portions 53 on opposed side edges of the slot 50. As shown in FIG. 17, the embossed shoulder portions have a sloped lower end section 54 and a flat plateau 55, and these are disposed inwardly of the flat wall portion 48 facing the same direction as the inclined connecting end flanges 49 and 49'.

The molding piece 17 is secured against the wall surface 11 by aligning the wall attaching plates in the channel 30 with fasteners 47 having been screwed within the wall surface 11 along a straight line and at intervals therealong. Each of the plates are lined up with the screw heads and then the molding is placed to position the screw heads in the opening 51 of the slot. The molding is then pushed downwardly towards the floor surface 12 with the screw head riding up on the sloped portion 54 of the embossment 52 pulling the molding 17 against the wall surface 11. When the screw head reaches the plateau 55 a constant pulling pressure is applied on the molding causing the molding to follow imperfections in the wall surface. To remove the molding it is simply necessary to place a prying tool under the lower edge 60 of the molding, and by pushing it upwardly it will release the pressure exerted by the screw heads 46 and it is then disconnected by lifting the molding.

As shown in FIGS. 15, 18 and 19, end connectors 61 are secured in the channel 30 at an end of the molding piece 17 where it is necessary to connect to a further decorative molding piece, such as the inner corner molding piece 20 and outer corner molding piece 21, as shown in FIG. 1 and also better illustrated in FIGS. 20 to 22. The end connector 61 is formed similarly to the end connector previously described with reference to FIGS. 11 and 12 with the exception that the decorative molding piece connector 61 is provided at an end thereof with opposed undulated metal strips 62 and 62' interconnected at a center portion 63 and having opposed free ends 64 and 64'. These undulations are provided for the same purpose as the previously described end connector 35, namely for frictional retention within the connecting slot of the corner molding pieces 20 and 21. The connectors and clamps are formed of spring steel or other material capable of retaining their shape.

As shown in FIGS. 20 and 21, it can be seen that the inside corner connecting piece 20 has a decorative outer side 70 and an elongated vertical slot 71 in opposed right-angle walls 72 and 72' thereof. This end connector is simply slid in the inside corner 14 and the fingers 62' and 62 slide within a respective one of the slots 71. To remove the corner piece it is merely necessary to pry it upwards against frictional pressure of the undulations 65 provided in the fingers 62 and 62', as shown in FIG. 19. As shown in FIG. 19, these fingers extend in the same plane as the channel connecting portion 68 of the connector 61. It is of course to be understood that various other decorative connecting pieces may be connected to these moldings. Although the moldings as herein shown are wood moldings, they may also be plastic or metal extruded moldings, and the corner pieces could also be the same.

It is within the ambit of the present invention to cover any other obvious modifications of the preferred embodiment described herein, provided such modifications fall within the scope of the appended claims.

I claim:

1. An architectural molding assembly for use in building construction comprising one or more straight molding pieces having an outer surface, said molding pieces being formed of solid core material, a channel disposed longitudinally in at least portions of an inner face of said one or more molding pieces and each said channels having opposed longitudinal under cut grooves in opposed edges thereof, a wall attaching plate removably securable in sliding fit between said undercut grooves, said attaching plate having a transverse fastener receiving slot therein, said slot having a fastener head receiving opening at a lower end thereof, said plate having sloped shoulder portions on opposed side edges of at least a portion of said slot, said shoulder portions being elevated from an outer surface of said plate, said plate having connecting end flanges angled outwardly above said outer surface slidingly securing said plate in said channel between said undercut grooves with said slot extending vertically with respect to said molding piece and said sloped shoulder facing inwardly of said channel and spaced from a bottom wall of said channel, said molding assembly further comprising two or more fasteners, said molding piece being securable against a wall surface of a room of a building by said two or more fasteners secured in said wall, each said fasteners having a fastener head, said fasteners adapted to be anchored in said wall with said head of said fasteners spaced outwardly a predetermined distance, said fastener heads being received in a respective one of said fastener head receiving opening of a respective one of two or more of said wall attaching plates disposed in said channel and aligned with said fasteners by sliding said plates in said channel, said molding piece adapted to be secured to said wall by pressing said molding piece in the direction of said wall and in a downward motion to cause said fastener heads to enter said fastener head receiving opening of said wall attaching plates and to frictionally engage with said elevated shoulder portions of said wall attaching plates to draw said molding against said wall with said plate maintaining a pulling force on said molding to clamp said molding against said wall surface.

2. A molding assembly as claimed in claim 1 wherein said fastener head receiving opening is an enlarged opening formed at a bottom end of said slot for ease of alignment of said fastener head therein.

3. A molding assembly as claimed in claim 1 wherein said sloped shoulder portions define a slope section from said enlarged opening to an elevated plateau section extending from a predetermined position along said slot to a top end of said slot.

4. A molding assembly as claimed in claim 1 wherein there is further provided an end connector secured in said channel at an end of said molding piece to connect a further decorative molding piece adjacent said end.

5. A molding assembly as claimed in claim 4 wherein said end connector is a metal plate having a channel connecting portion adapted for sliding retention in said channel, and a decorative molding piece connecting end portion extending outwardly from an end of said channel for removable retention of said further decorative molding piece.

6. A molding assembly as claimed in claim 5 wherein said molding piece connecting end is comprised of opposed flat metal fingers having an undulation therein for frictional retention within a connecting slot of said further decorative molding piece.

7. A molding assembly as claimed in claim 1 wherein said molding pieces are wood moldings, said channel extending longitudinally across said inner face of said molding piece, said two or more fasteners being screw fasteners.

8. An architectural molding assembly comprising one or more straight molding pieces having an outer surface, a channel disposed longitudinally in at least portions of an inner face of said one or more molding pieces and each having opposed longitudinal grooves in opposed edges of said channel, a wall attaching plate removably securable between said grooves, said attaching plate having a clamp receiving aperture in a lower portion thereof and opposed connecting end flanges slidingly securing said plate in said channel with said aperture disposed in a lower portion of said molding piece and said plate spaced from said inner face, said molding assembly further comprising one or more fastening brackets with a projecting finger, said molding piece adapted to be secured against a wall surface and a ceiling surface by said one or more fastening brackets secured to said wall adjacent said ceiling surface with said projecting finger of each said fastening brackets extending outwardly upwards a predetermined distance, said projecting finger being received in said clamp receiving aperture of an associated attaching plate disposed in said channel, said molding piece adapted to be secured to said wall and against an adjacent ceiling surface by positioning said molding to make said projecting finger of said brackets enter said aperture of an associated attaching plate secured in said channel of said molding piece and by pushing said molding in clamping position between said wall and said ceiling to cause said finger to enter said clamp receiving aperture of said associated attaching plate, said finger maintaining a pulling force on said associated attaching plate and molding piece to clamp said molding piece between said wall and ceiling surface.

9. A molding assembly as claimed in claim 8 wherein said wall attaching plate is a flat metal plate having an outwardly angulated wall section above said aperture to receive said projecting finger in sliding frictional engagement therewith.

10. A molding assembly as claimed in claim 8 where there is further provided an end connector secured in said channel at an end of said molding piece to connect a further decorative molding piece adjacent said end.

11. A molding assembly as claimed in claim 10 wherein said end connector is a metal plate having a channel connecting portion adapted for sliding retention in said channel, and a decorative molding piece connecting end portion extending outwardly from an end of said channel for removable retention of said further decorative molding piece.

12. A molding assembly as claimed in claim 11 wherein said molding piece connecting end is comprised of a metal finger having an undulation therein for frictional retention with a connecting slot of said further decorative molding piece.

13. A molding assembly as claimed in claim 12 wherein said further decorative molding piece is a right-angle bridge piece interconnected between adjacent spaced ends of two of said decorative molding pieces disposed at right angles to one another.

14. A molding assembly as claimed in claim 8 wherein said one or more fastening brackets each comprise a wall attaching body portion with said projecting finger formed integral therewith and extends outwardly from a lower end of said wall attaching body portion, one or more holes in said wall attaching body portion for securing same to a wall by fasteners.

* * * * *